US005967658A

United States Patent [19]

Mohajer

[11] Patent Number: 5,967,658

[45] Date of Patent: Oct. 19, 1999

[54] STATIC MIXING APPARATUS AND METHOD

[75] Inventor: Kim Mohajer, Houston, Tex.

[73] Assignee: KAM Controls Incorporated, Houston, Tex.

[21] Appl. No.: 09/123,824

[22] Filed: Jul. 28, 1998

[51] Int. Cl.[6] ..... B01F 5/06

[52] U.S. Cl. ..... 366/337; 138/42

[58] Field of Search ..... 366/340, 336, 366/337, 338, 174.11, 175.2; 138/40, 42, 44

[56] References Cited

U.S. PATENT DOCUMENTS

| | | | |
|---|---|---|---|
| 864,196 | 8/1907 | Rollins | 138/40 |
| 1,199,243 | 9/1916 | Bushey | 138/40 |
| 1,569,519 | 1/1926 | Middlaugh | 138/40 |
| 1,605,401 | 11/1926 | Hamilton | 138/40 |
| 2,561,457 | 7/1951 | Beales et al. | 138/42 |
| 2,688,986 | 9/1954 | O'brien | 138/42 |
| 3,267,918 | 8/1966 | Ayres | 138/42 |
| 3,923,288 | 12/1975 | King . | |
| 4,034,965 | 7/1977 | King . | |
| 4,208,136 | 6/1980 | King . | |
| 4,220,416 | 9/1980 | Brauner et al. | 366/337 |
| 4,255,124 | 3/1981 | Baranowski, Jr. | 366/338 |
| 5,378,063 | 1/1995 | Tsukada | 366/340 |

FOREIGN PATENT DOCUMENTS

| | | | |
|---|---|---|---|
| 1807922 | 6/1969 | Germany | 366/338 |
| 6-226070 | 8/1994 | Japan | 366/337 |
| 24309 | 3/1914 | Norway | 366/337 |

*Primary Examiner*—Tony G. Soohoo
*Attorney, Agent, or Firm*—Browning Bushman

[57] ABSTRACT

A method and apparatus having no moving parts for mixing materials and homogenizing multiphase flow in a very short section of the conduit (10) utilizing the energy from the moving fluid without the use of external energy. The mixing device (20) has a pair of generally semicircular openings (28, 30) separated by a diametrically extending post (32) and a pair of deflector wings (34, 36) extending in an inclined relation from the post (32) for dividing the multiphase flow into two counter-rotating flow streams (40, 42) which result in a homogenous singlephase flow stream.

15 Claims, 5 Drawing Sheets

FIG. 5
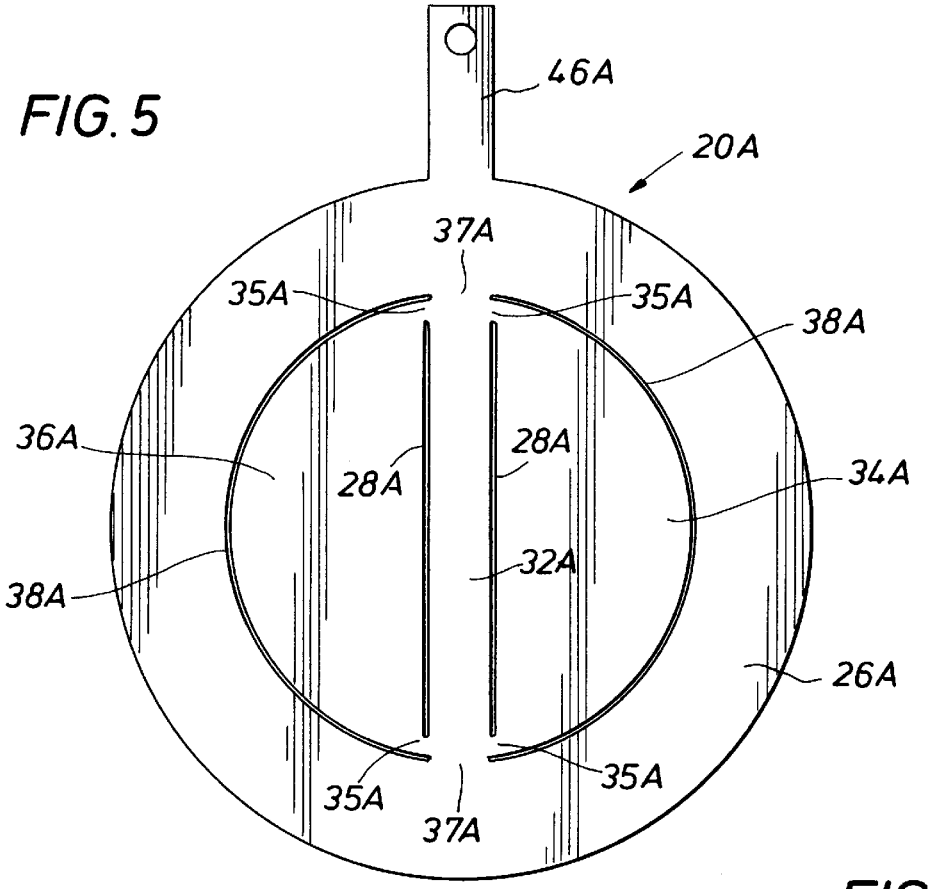
FIG. 7
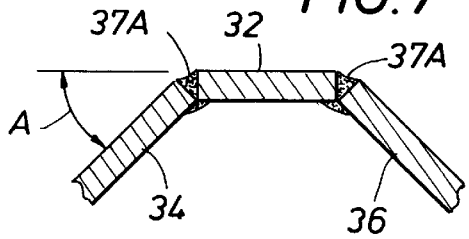
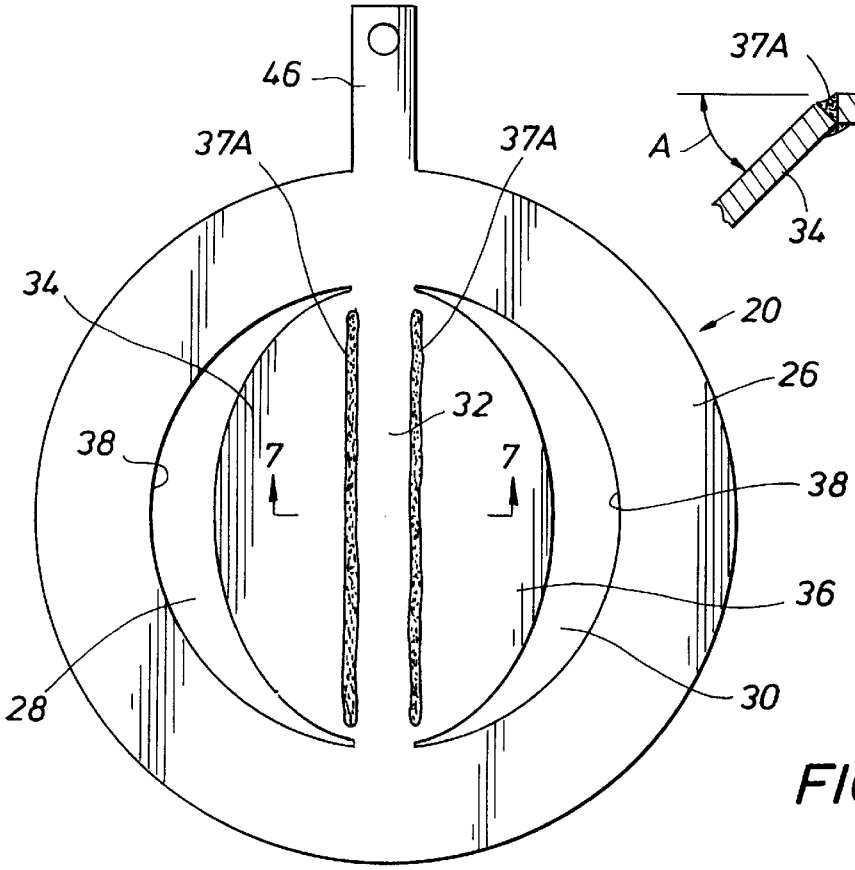
FIG. 6

STATIC MIXING APPARATUS AND METHOD

FIELD OF THE INVENTION

The present invention relates to a method and apparatus, having no moving parts, for mixing materials and homogenizing multiphase flow in a very short section of the conduit utilizing the energy from the moving fluid without the use of external energy. The apparatus divides the multiphase flow into two counter-rotating flow streams which result in a homogenous singlephase flow stream.

BACKGROUND OF THE INVENTION

Static mixing apparatus having no moving parts has been utilized theretofore such as shown in U.S. Pat. No. 4,208,136, for example. The materials to be mixed may be liquids, solids, or gases, and non-uniformities in such materials occur in various characteristics or properties such as color, density, or temperature, for example. A multiphase flow includes two or more different materials to be mixed during fluid flow along the conduit. The materials are inserted within the conduit upstream of the mixing apparatus. Mixing of materials may be achieved by obstruction in the fluid flow path of a conduit. Baffles may be arranged in a conduit or pipe that divide and recombine fluid streams in a systematic fashion in order to minimize pressure drop. However, the length of mixing process within the pipe or conduit may be relatively long which produces a relatively high pressure drop in the mixing conduit. A pressure drop requires additional energy for moving the material along the conduit.

It is desirable that a minimum length of conduit be utilized for a mixing chamber and that a minimal pressure drop be obtained.

SUMMARY OF THE INVENTION

The present invention comprises a method and apparatus which address the prior art problems with respect to the long length conduit or pipe required. It is apparent that there is a need in the stationary material mixing art for an apparatus which provides a homogenous material downstream of the apparatus with minimum length. This invention is particularly well suited for, but is not limited to, mixing multiphase flow for flow measurement, sampling, blending, additive injection, homogenizing building materials, adhesives, foods, fire fighting foam, etc.

The apparatus is positioned along the longitudinal axis of the flow conduit for mixing materials in a multiphase flow. The apparatus which has no moving parts is held in place along the periphery of the conduit or may be inserted between two flanges. The multiphase flow is divided into two streams creating two counter-rotating flow streams or two counter-rotating streams of vortices. These counter-rotating forces continue rotating until the energy added to the flow is totally dissipated, thereby creating a homogenous singlephase flow over a short distance with minimum pressure drop. The apparatus is comprised of two wings which create the two counter-rotating flows and a ring with a handle to hold the apparatus in the conduit or between two flanges.

The present invention homogenizes the materials such as two or three fluids in a conduit such as pipe in a very short length of pipe and with minimal pressure drop. The apparatus is held in place along the periphery of the conduit or may be inserted between two flanges. The apparatus is particularly useful with laminar flows where there is no turbulence in the flow to assist in the homogenization.

The mixing apparatus preferably comprises a mixing plate which is positioned within a tubular conduit having a cylindrical flow passage or chamber,. The mixing plate has a pair of side by side openings separated by a center post. A pair of deflector wings extend in a downstream direction from the center post in an inclined relation and in a covering relation to the openings so that the materials to be mixed flow through the spaced openings in two flow streams and are deflected by the deflector wings into a pair of turbulent streams rotating in opposite directions for mixing of the materials. The openings have outer contours conforming generally to the inner peripheral surface of the conduit. After being deflected by the deflector wings into a pair of counter-rotating streams, the counter-rotating streams combine to form a generally laminar flow a relatively short distance downstream of the mixing plate. Thus, a relatively short length mixing chamber is utilized. For example, for a conduit having a diameter of 10 inches, the mixing device or plate requires an axial length of about 3½ inches and laminar flow after mixing occurs an axial distance downstream of the mixing device equal to about ten times the diameter of the conduit dependent primarily on the flow rate and viscosities of the materials being mixed.

Other features and advantages of the invention will be apparent from the following specification and drawings.

BRIEF DESCRIPTION OF THE DRAWINGS

FIG. 5 is a plan view of a flat mixing plate prior to fabrication and illustrating the cuts to be made for forming the mixing plate;

FIG. 6 is a plan view of the mixing plate after formed from the flat plate shown in FIG. 5;

FIG. 7 is a section taken generally along line 7—7 of FIG. 6;

DESCRIPTION OF THE INVENTION

Figure 1:
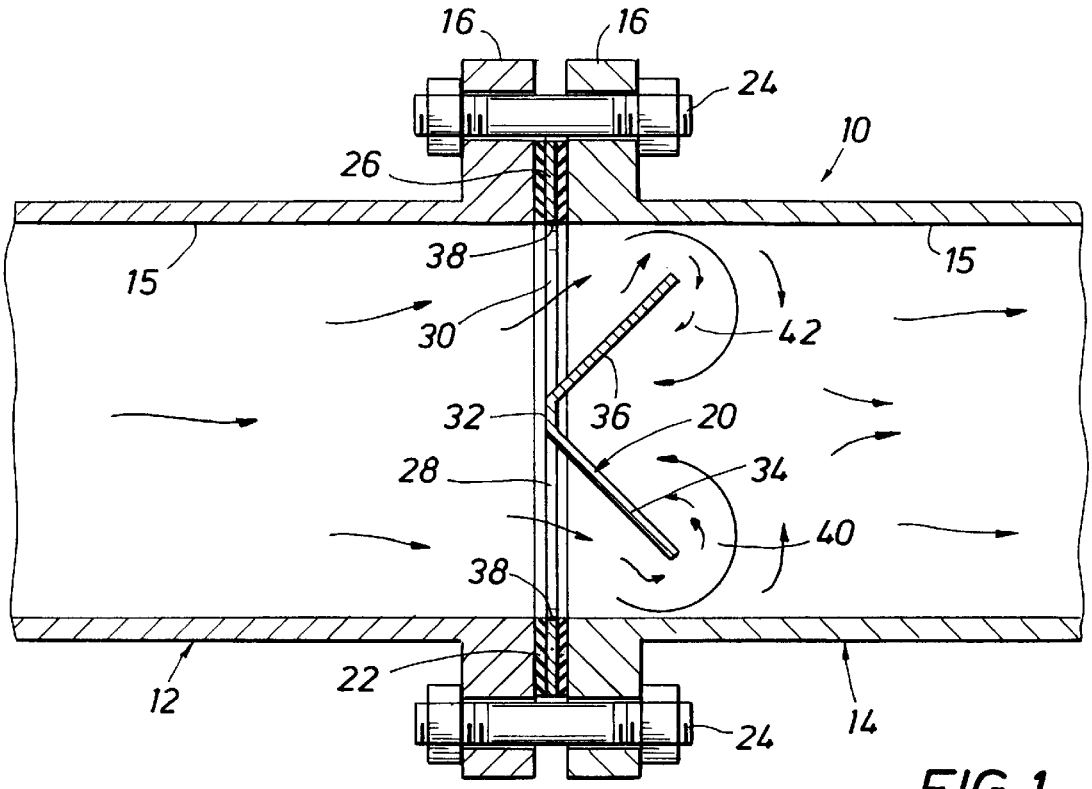
FIG. 1 is a horizontal longitudinal sectional view of the mixing apparatus of the present invention secured between opposed end flanges of pipe sections of a pipeline or flow conduit.

Referring now to the drawings for a better understanding of this invention and more particularly to the embodiment shown in FIGS. 1–6, a conduit or pipeline is shown generally at 10 including a pair of adjacent conduit sections 12 and 14 having an inner peripheral surface 15. Conduit section 12 forms an upstream conduit section and conduit section 14 forms a downstream conduit section with the arrows indicating the direction of flow of the multiphase materials to be mixed. As indicated previously, the materials to be mixed may be liquids, solids or gases having various characteristics and viscosities. The materials to be mixed are injected within conduit 10 upstream of conduit section 12.

Conduit sections 12, 14 have opposed end flanges 16 spaced from each other. Fitting between opposed flanges 16 is the mixing device or apparatus of the present invention indicated generally at 20. Suitable gaskets 22 are positioned between mixing device 20 and end flanges 16. Suitable aligned openings are provided in flanges 16 and fasteners 24 comprising suitable stud and nut combinations are received within the aligned openings and tightened so that device 20 is gripped tightly between flanges 16 by frictional contact.

Figure 2:
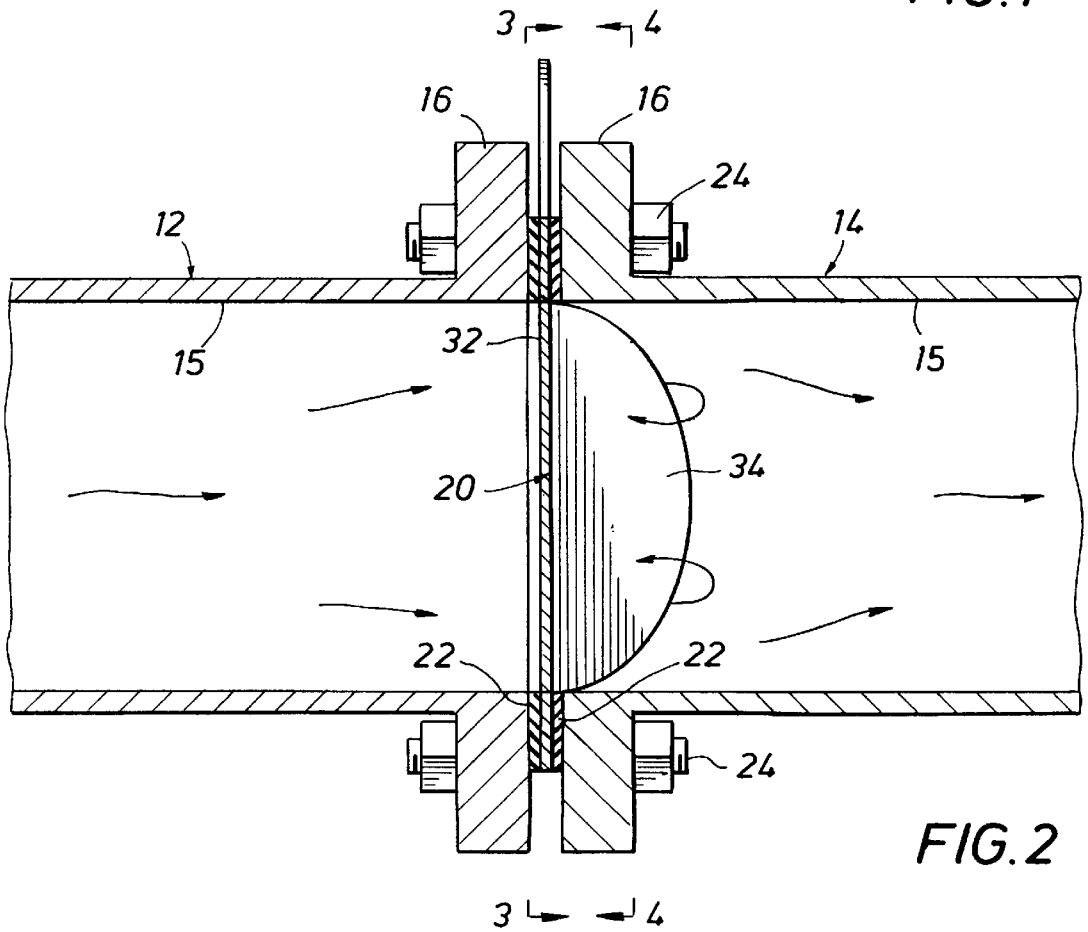
FIG. 2 is a vertical longitudinal sectional view of the mixing apparatus shown in FIG. 1 showing particularly the two counter-rotating flow streams created after the laminar flow stream passes through the mixing apparatus.
Figure 3:
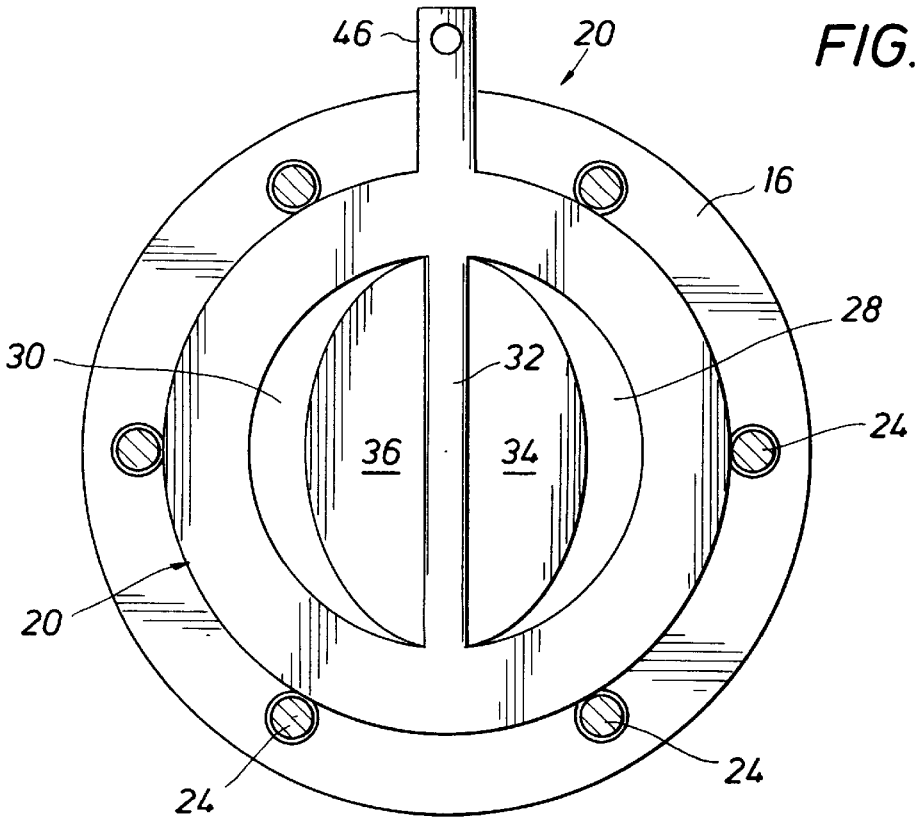
FIG. 3 is a section taken generally along line 3—3 of FIG. 2 from the upstream side of the mixing device.
Figure 4:
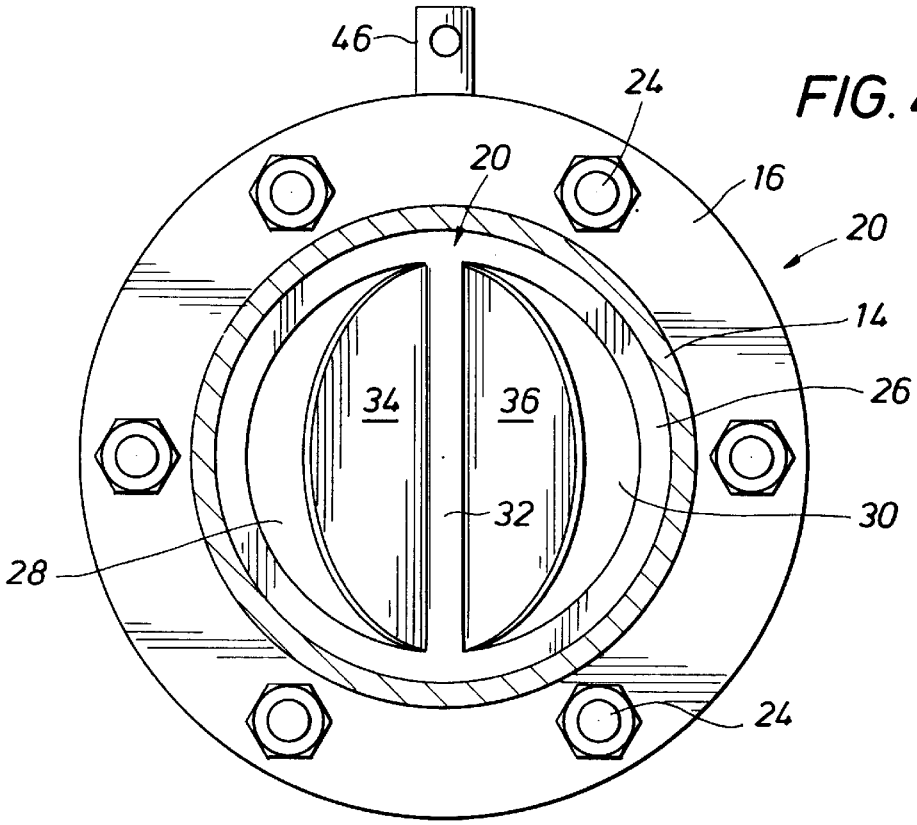
FIG. 4 is a section taken generally along line 4—4 of FIG. 2 from the downstream side of the mixing device.

Mixing device or mixing plate 20 is shown in FIG. 6 removed from conduit 10 and is formed from a flat plate illustrated in FIG. 5. Mixing plate 20 has an outer band or ring 26 defining a pair of spaced, generally semicircular, openings 28, 30 and a post 32 separating openings, 28, 30 which are arranged in a side-by-side relation. Extending from post 32 in a covering relation to semicircular openings 28, 30 are a pair of deflector wings 34, 36. Wings 34, 36 as shown particularly in FIG. 2 are inclined at an angle A relative to the transverse axis of conduit 10. Angle A is preferably between about forty degrees and sixty degrees and an optimum of about fifty degrees. Under certain conditions an angle A between about twenty-five degrees and seventy degrees would function in a satisfactory manner.

Each semicircular opening 28, 30 defines an outer arcuate edge or peripheral surface 38 which is in axial alignment with and forms a smooth continuation of inner peripheral surface 15 of adjacent conduit sections 12 and 14. Mixing device 20 has a handle 46 aligned with post 32 and extends outwardly of adjacent conduit sections 12 and 14. Handle 46 may be gripped manually upon loosening of fasteners 24 for rotation of device 20 to a desired position of openings 28 and 30 between adjacent nut and bolt combinations 24. Then, fasteners 24 are tightened for securement of mixing device 20 at the desired position.

In operation, two or more materials in a multiphase flow to be mixed are injected upstream of conduit section 12. The materials are divided by mixing device 20 and flow through semicircular openings 28, 30 in two streams which contact deflector wings 34, 36. Upon contact with deflector wings 34, 36 the two divided streams form two counter-rotating flow streams 40 and 42 as shown in FIG. 2. Flow stream 40 rotates in a counter-clockwise direction and flow stream 42 rotates in a clockwise direction as shown in FIG. 2. Turbulence of flow streams 40 and 42 continues until the energy added to the flow is totally dissipated, thereby creating a homogenous singlephase flow with a minimum pressure drop. The flow streams are directed by the inclined deflector wings 34 and 36 toward the inner peripheral surface 15 of conduit section 14 to provide an effective mixing of the material flowing along the walls of conduit 10. The axial distance along conduit section 14, at which laminar or single phase flow occurs, varies dependent primarily on the flow rate and the viscosities of the materials being mixed. Generally, laminar flow occurs at an axial distance from mixing device 20 equal to about ten to fifteen times the diameter of conduit 10. Openings 28 and 30 for conduit 10 extending in a horizontal direction are preferably positioned with opening 28 below opening 30 particularly for certain materials to be mixed such as water and oil. Since water is heavier than oil the water flows through the lower opening 28.

As a specific but non-limiting example, the mixing apparatus of the present invention was tested in a thirty inch diameter carbon steel conduit, with crude oil flowing at a rate of 5000 barrels per hour. The base line crude oil had a water content of 0.05% in volume. One percent water was added to the crude oil upstream of mixing plate 20 at the bottom of conduit 10. It is pointed out that water stratifies at the bottom of a conduit and travels at a lower velocity than crude oil. A sampler was installed downstream of mixing plate 20 at a distance equal to three times the diameter of conduit 10 or 90 inches. Ten samples at each one inch increment from the top to the bottom of conduit 10 were taken with a total of 280 samples. Using a coulometric Karl Fischer Titration to measure the amount of water in the crude oil, the deviation of the 280 samples from the mean was −0.01%.

Referring more particularly to FIGS. 5–6, the method for fabricating mixing device 20 is illustrated. A flat plate material as shown in FIG. 5 at 20A is provided and cuts made by a suitable laser beam are illustrated at 28A and 38A with portions shown at 35A and 37A being uncut. Plate portions 34A and 36A are then bent outwardly of plate 20A about uncut portions 35A at an angle A of about fifty degrees leaving a central post 32A extending diametrically of an outer ring 26A formed along an outer marginal portion of plate 20A. The seams or lines between post 32A and bent plate portions 34A and 36A which form deflectors are then welded at 37A to form mixing device 20 as shown in FIG. 6.

Figure 8:
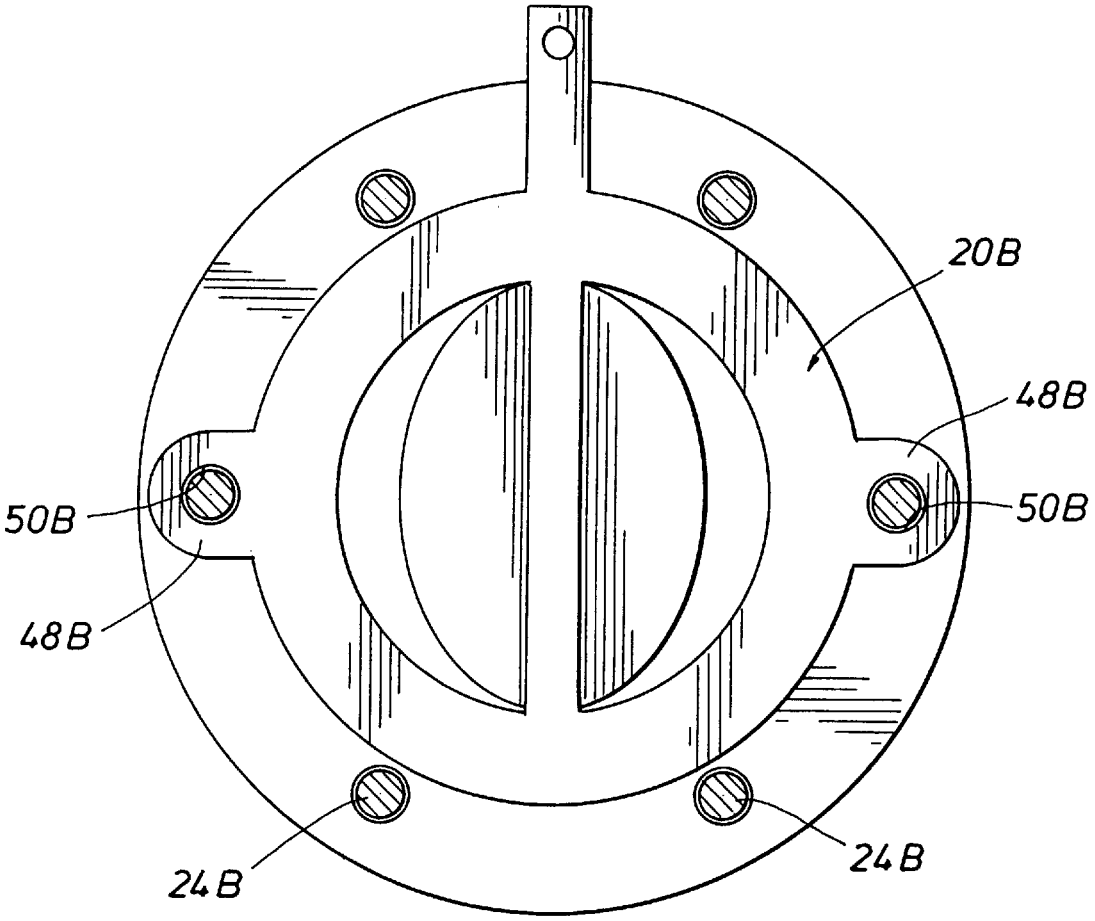
FIG. 8 is an elevational view of a separate embodiment of the invention in which fasteners for the pipeline flanges extend through extensions on the mixing plate for securement of the mixing plate.

As shown in the embodiment of FIG. 8, mixing plate 20B may be provided with retaining lugs 48B having openings 50B if it is desired to have fasteners 24B extending through openings 50B for mounting mixing device 20B between conduit sections.

While mixing device 20 has been illustrated as a mixing plate secured between opposed flanges of conduit or pipe sections, the mixing device could comprise only a post and attached deflector wings secured within a pipe or conduit.

Figure 9:
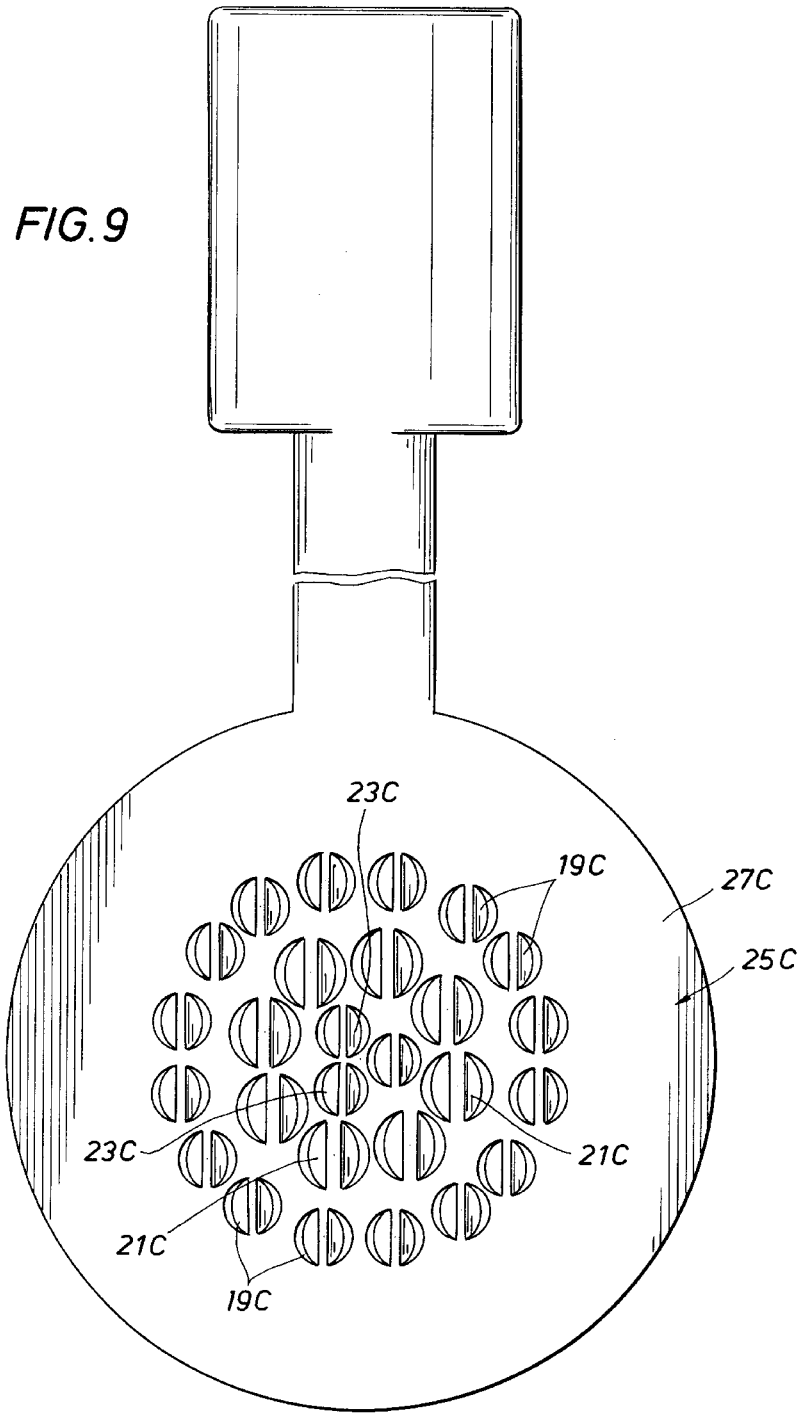
FIG. 9 is an end elevation of another embodiment of the invention in which a plurality of transversely aligned individual mixing devices of various sizes are mounted on a plate within a pipeline or conduit for separating the main flow stream into a plurality of separate small streams which are recombined downstream of the mixing device.

Embodiment of FIG. 9

A further embodiment of the invention is shown in FIG. 9 in which a plurality of generally parallel mixing devices or elements 19C, 21C and 23C of various sizes is mounted on plate 25C. Mixing elements 19C are arcuately spaced about an outer circle. Mixing elements 21C of relatively large diameter are arcuately spaced about an intermediate circle and mixing device 23C of a relatively small diameter are arcuately spaced about an inner circle. Plate 25C is mounted between a pair of opposed conduit sections and gripped about an outer marginal edge portion 27C as in the embodiment shown in FIGS. 1–7. Each mixing device 19C, 21C and 23C is generally similar to mixing device 20 as shown in the embodiment of FIGS. 1–7. The stream is divided into multiple streams by mixing elements 19C, 21C and 23C. The embodiment of FIG. 9 is utilized particularly for large diameter flow conduits having a diameter over about thirty-six inches, for example.

The present invention as set forth above is effective in achieving an effective mixing of materials over a short distance with a minimum pressure drop.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Apparatus for mixing materials and having no moving parts; said apparatus comprising:

a longitudinally extending tubular conduit having an axially extending chamber defining an inner peripheral surface;

a mixing member within said conduit positioned transversely of said chamber and having a pair of side by side openings therein, and a post separating said openings extending diametrically across said chamber, said openings defining an outer arcuate surface in axial alignment with and forming generally a continuation of said inner peripheral surface of said conduit whereby the materials to be mixed flow through said openings from an upstream side of said mixing member to a downstream side of said mixing member; and a pair of deflector wings extending downstream from said post in an inclined direction relative to the longitudinal axis of said conduit so that the materials to be mixed pass through said openings and are deflected by said deflector wings to provide a pair of counter-rotating flow streams for mixing of said materials.

2. Apparatus as set forth in claim 1 wherein said openings are of a generally semicircular shape.

3. Apparatus as set forth in claim 1 wherein said mixing member comprises a plate having said openings extending therethrough.

4. Apparatus as set forth in claim 1 wherein:

said conduit includes a pair of conduit sections having spaced end flanges in opposed relation to each other, and said mixing member is secured between said end flanges.

5. Apparatus as set forth in claim 4 wherein:

said mixing member is gripped between said end flanges and held in position by frictional contact with said end flanges.

6. Apparatus as set forth in claim 4 wherein fasteners extend through said end flanges and said mixing member to hold said mixing member in position between said flanges.

7. Apparatus as set forth in claim 1 wherein said mixing member comprises a plate having a pair of generally semicircular openings extending therethrough and said deflector wings are of a generally semicircular shape in a covering relation to said openings.

8. Apparatus for mixing materials and having no moving parts; said apparatus comprising:

a longitudinally extending tubular conduit having an axially extending cylindrical chamber defining an inner peripheral surface of a cylindrical shape;

a mixing member within said conduit positioned transversely of said chamber and having a pair of generally semicircular openings therein, and a post separating said generally semicircular openings extending diametrically across said chamber, said openings defining an outer arcuate surface in axial alignment with and forming generally a continuation of said inner peripheral surface of said conduit whereby the materials to be mixed flow through said openings from an upstream side of said mixing member to a downstream side of said mixing member; and a pair of deflector wings of a generally semicircular shape extending downstream from said post in an inclined direction relative to the longitudinal axis of said conduit so that the materials to be mixed pass through said generally semicircular openings and are deflected by said semicircular deflector wings to provide a pair of counter-rotating flow streams for mixing of said materials.

9. Apparatus as set forth in claim 8 wherein said deflector wings extend downstream at an angle between about 15 degrees and 75 degrees relative to the transverse axis of said conduit.

10. Apparatus as set forth in claim 8 wherein said deflector wings extend downstream at an angle between about 40 degrees and 60 degrees relative to the transverse axis of said conduit.

11. A method of manufacturing a stationary mixing device for positioning within a tubular conduit for mixing materials flowing through the conduit; said method comprising the steps of:

providing a generally flat circular plate;

forming a pair of generally side by side openings in said plate divided by a diametrically extending post, the openings having an outer arcuate periphery for conforming generally to the inner peripheral surface of the tubular conduit; and extending a pair of deflector wings from said post in an inclined relation from a face of the plate and in a covering relation to said openings for forming downstream deflectors for materials flowing through said openings.

12. A method of manufacturing a stationary mixing plate as set forth in claim 11 including the steps of:

cutting a pair of generally semicircular lines in said plate; cutting at least one linear line for each of said semicircular lines extending between the ends of each semicircular line and leaving an uncut portion; and bending a semicircular plate section about the linear cut line and uncut portion between the ends of each semicircular line to form said inclined deflector wings in covering relation to openings formed by bending of said deflector wings.

13. A method of mixing materials within a longitudinally extending tubular conduit without any moving parts, the tubular conduit having an inner peripheral surface of a cylindrical shape; said method comprising the steps of:

providing a mixing plate having a pair of spaced side by side fluid flow openings separated by a post;

positioning a pair of deflector wings on said post extending in an inclined direction from said post and in an axially covering relation to said openings;

positioning said mixing plate within said conduit with said openings defining an outer arcuate surface aligned with the inner peripheral surface of said conduit and said wings extending from said post in a downstream direction; and inserting said materials to be mixed upstream of said mixing plate with said materials flowing in a stream along said conduit through said openings and against said deflector wings for dividing said stream into a pair of streams rotating in opposite directions for mixing of said materials.

14. The method of mixing materials as set forth in claim 13 including the steps of:

positioning said mixing plate between a pair of spaced opposed flanges on adjacent conduit sections; and securing said opposed flanges together for tightly mounting said mixing plate between said flanges and within said conduit.

15. The method of mixing as set forth in claim 13 wherein the step of positioning said mixing plate between a pair of opposed flanges includes gripping said mixing plate between said flanges to retain said mixing plate by frictional contact between said flanges;

said step of securing said opposed flanges together includes the positioning of fasteners on said flanges and the tightening of the fasteners for gripping said mixing plate tightly therebetween.

* * * * *